US006162124A

United States Patent [19]

Hiraoka et al.

[11] Patent Number: 6,162,124

[45] Date of Patent: Dec. 19, 2000

[54] CONTROL LEVER DEVICE

[75] Inventors: Takahiro Hiraoka, Akitsu-cho; Toshifumi Suzuki, Amagasaki, both of Japan

[73] Assignee: Konami Co., Ltd., Hyogo-ken, Japan

[21] Appl. No.: 08/959,019

[22] Filed: Oct. 28, 1997

[30] Foreign Application Priority Data

Nov. 5, 1996 [JP] Japan ..... 8-292926

[51] Int. Cl.[7] ..... A63F 9/22

[52] U.S. Cl. ..... 463/38; 273/148 B

[58] Field of Search ..... 463/38, 37, 36; 434/29, 45, 62, 65, 71; 273/148 B; 345/161, 157, 156; 74/89.14, 502.2

[56] References Cited

U.S. PATENT DOCUMENTS

| | | | |
|---|---|---|---|
| 4,852,419 | 8/1989 | Kittel et al. | 74/89.14 |
| 4,949,119 | 8/1990 | Moncrief et al. | 434/71 X |
| 5,044,956 | 9/1991 | Behensky et al. | 434/62 X |
| 5,056,787 | 10/1991 | Mitsuyoshi | 273/148.13 X |
| 5,209,661 | 5/1993 | Hildreth et al. | 273/148.13 X |
| 5,214,979 | 6/1993 | Crack | 74/502.2 |
| 5,370,536 | 12/1994 | Chuang | 434/62 |
| 5,607,308 | 3/1997 | Copperman et al. | 434/62 |
| 5,643,087 | 7/1997 | Marcus et al. | 463/38 |
| 5,800,267 | 9/1998 | Carlson et al. | 463/38 |
| 5,829,745 | 11/1998 | Houle | 273/148.13 |

FOREIGN PATENT DOCUMENTS

| | | |
|---|---|---|
| 0515160 | 11/1992 | European Pat. Off. . |
| 2611615 | 9/1988 | France . |

*Primary Examiner*—Mark A. Sager
*Attorney, Agent, or Firm*—Jordan and Hamburg LLP

[57] ABSTRACT

A control lever device suited for use as a hand brake or the like in a driving game machine and capable of achieving a realistic game machine. In the control lever device, a lever is mounted at one end of a shaft so that it turns together with the shaft, and a gear support plate is mounted at the center of the shaft. The gear support plate is provided with a transmitting gear which meshes with a transmitted gear mounted on a rotary shaft of a variable resistor. The turning motion of the lever is transmitted to the rotary shaft of the variable resistor, and the resistance of the variable resistor is changed in accordance with the amount of turn of the lever. Mounted at the other end of the shaft is an urging force applying member having an urging force generating characteristic wherein the generation rate of the urging force relative to the amount of turn of the lever increases with increase in amount of turn of the lever. The gear support plate is provided with another urging force applying member formed of a tension coil spring.

18 Claims, 5 Drawing Sheets

CONTROL LEVER DEVICE

BACKGROUND OF THE INVENTION

1. Field of the Invention

The present invention relates to a control lever device, and more particularly, to a control lever device suited for use in a game machine such as a driving game machine which allows a player to drive a vehicle like a car displayed on a monitor under the control of the player.

2. Description of the Related Art

In a conventional popular type of driving game machine, a player sits on a seat simulating a driver's seat of a car which is provided with controllers such as a steering wheel, an accelerator pedal and a brake pedal, and controls the controllers while viewing a three-dimensional image displayed on a monitor composed of a cathode-ray tube and the like, thereby imitatively driving a car in the monitor. In such a conventional driving game machine, the running direction of the car is changed by operating the steering wheel, and the speed of the car is changed by using the accelerator pedal and the brake pedal, which produce a realistic feeling of actually driving the car.

As a means for increasing the complexity of driving operations and thereby adding more realism to the above-mentioned driving game machine, it is conceived that the body of the car is spun by turning the steering wheel while driving after the rear wheels have been locked by operating a hand brake which is provided for applying a braking force only to the rear wheels.

However, even if the above-mentioned driving game machine having a hand brake is practiced, unless the hand brake offers a feeling similar to an actual hand brake of a car, there is a fear that more realism will not be obtained, while driving operations of the car are made more complicated.

SUMMARY OF THE INVENTION

Accordingly, it is an object of the present invention to provide a control lever device which is suited for use as a hand brake or the like in a driving game machine and which contributes to the achievement of a realistic game machine.

In order to achieve the above object, according to an aspect of the present invention, a control lever device comprises a lever, a turning mechanism for allowing the lever to turn between a reference position and a terminal position, a detecting means for detecting the amount of turn of the lever from the reference position, and an urging force applying member for applying, in turning the lever, an urging force to the lever in a direction which returns the lever to the reference position, and having an urging force generating characteristic wherein the generation rate of the urging force relative to the amount of turn of the lever increases as the amount of turn of the lever increases.

In the above control lever device, when the turning force is applied to the lever, an urging force, whose amount increases with increase in amount of turn of the lever, is applied to the lever by the urging force applying member, and the turning motion of the lever is transmitted to the detecting means for detecting the amount of turn.

Preferably, the turning mechanism has a shaft mounted at the turn center of the lever, and the urging force applying member comprises a many-sided cylindrical member, a prismatic member having a similar shape to the many-sided cylindrical member and loosely fitted in the many-sided cylindrical member with a phase difference of half a pitch in the circumferential direction, and pillar-shaped elastic members to be press-fitted between the corners of the many-sided cylindrical member and the prismatic member.

In the above control lever device, when the turning force is applied to the lever, the shaft turns and the prismatic member turns inside the many-sided cylindrical member while compressing and deforming the elastic members. As a result, an urging force for urging the lever in a direction which returns the lever to the reference position is generated, and the lever is thereby turned smoothly.

Preferably, the shaft has a turn transmitting member to be turned together therewith, and the detecting means has a rotary shaft with a turn transmitted member and obtains an electrical characteristic corresponding to the amount of turn of the rotary shaft. The turn transmitted member is turned by the turn transmitting member.

The turning motion of the shaft is transmitted to the turn transmitted member mounted on the rotary shaft of the detecting means through the turn transmitting member to be turned together with the shaft. Consequently, the electrical characteristic corresponding to the amount of turn of the rotary shaft is output from the detecting means.

Preferably, the turn transmitting member comprises a gear support plate integrally mounted on the shaft and a transmitting gear mounted on the gear support plate concentrically with the shaft, and the turn transmitted member is composed of a transmitted gear engaged with the transmitting gear.

The turning motion of the shaft is accurately transmitted to the transmitted gear mounted on the rotary shaft of the detecting means by the transmitting gear mounted on the gear support plate.

The control lever device may be provided with stoppers for regulating the reference position and the terminal position of the lever by the contact of the gear support plate therewith.

The reference position and the terminal position defining a turn area of the lever are accurately regulated by the contact of the gear support plate with the stoppers.

The control lever device may be provided with another urging force applying member for applying, in turning the lever, an urging force to the lever in a direction which returns the lever to the reference position, in cooperation with the foregoing urging force applying member.

When the turning force is applied to the lever, an urging force, whose amount increases with increase in amount of turn of the lever, is applied to the lever by both the urging force applying members. When the turning operation of the lever is released, the lever is speedily returned to the reference position by both the urging force applying members.

The above-mentioned another urging force applying member may be formed of a tension coil spring.

When the turning force is applied to the lever, an urging force is applied to the lever by the tension coil spring, and the lever is thereby speedily returned to the reference position.

DESCRIPTION OF THE PREFERRED EMBODIMENT

Figure 1:
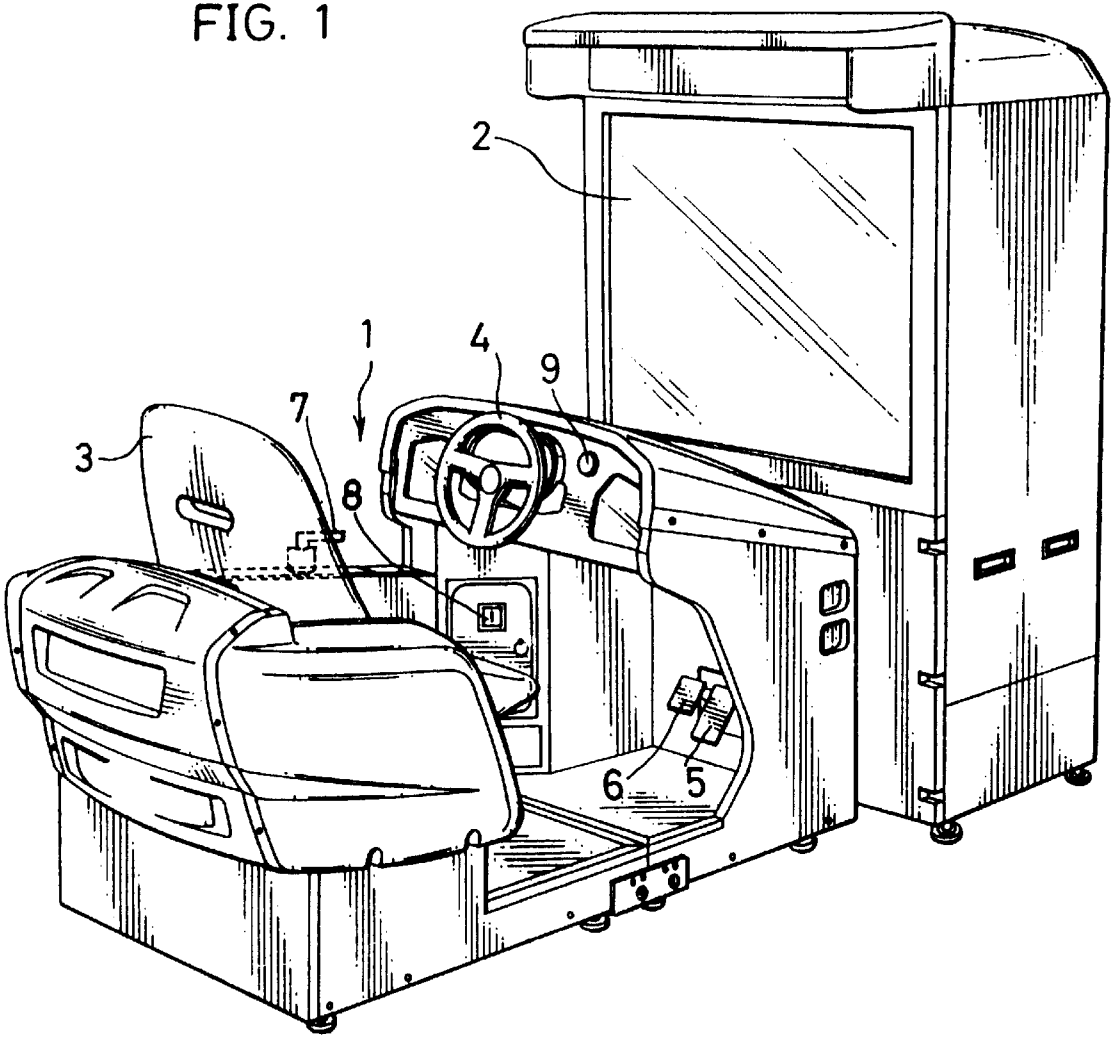
FIG. 1 is a perspective view of a driving game machine to which a control lever device of the present invention is applied as a hand brake.

FIG. 1 is a perspective view of a driving game machine to which a control lever device according to an embodiment of the present invention is applied as a hand brake. Referring to FIG. 1, the driving game machine comprises a driver's seat 1 and a monitor 2. The driver's seat 1 is, in a similar manner to the driver's seat of an actual car, provided with a seat 3, a steering wheel 4, an accelerator pedal 5, a brake pedal 6, and a control lever device 7 adopted as a hand brake. The driver's seat 1 is also provided with a coin slot 8 located in the left front of the seat 3, into which a coin is inserted before starting a game, and a start switch 9 located on the right side of the steering wheel 4 to command the start of the game. The monitor 2 composed of a CRT (cathode-ray tube), an LCD (liquid crystal display), a projector and the like displays images of cars and the like, and is placed in front of the driver's seat 1.

In the driving game machine constructed as mentioned above, when a player sits on the seat 3, puts the coin into the coin slot 8 and presses the start switch 9, the monitor 2 displays thereon, for example, a road including straight and curved sections on which cars run, general cars running on the road and serving as obstacles, an opponent car running under computer control, the player's own car to be controlled by the player, and the like. Then, the player skillfully operates the steering wheel 4, the accelerator pedal 5, the brake pedal 6 and the control lever device 7 serving as a hand brake, so that his car competes with the opponent car for the first arrival at the goal while passing the general cars.

The control lever device 7 serving as a hand brake puts the rear wheels into a locked state by applying the braking force only to the rear wheels through the turning motion thereof. The rear wheels do not lock if the amount of turn of the lever is small when the running speed of the player's car is low, and are locked by a small amount of turn of the lever when the running speed is high. When the steering wheel 4 is operated in a state in which the rear wheels are locked, the body of the car is spun, and the running direction of the car is thereby changed rapidly.

Figure 2:
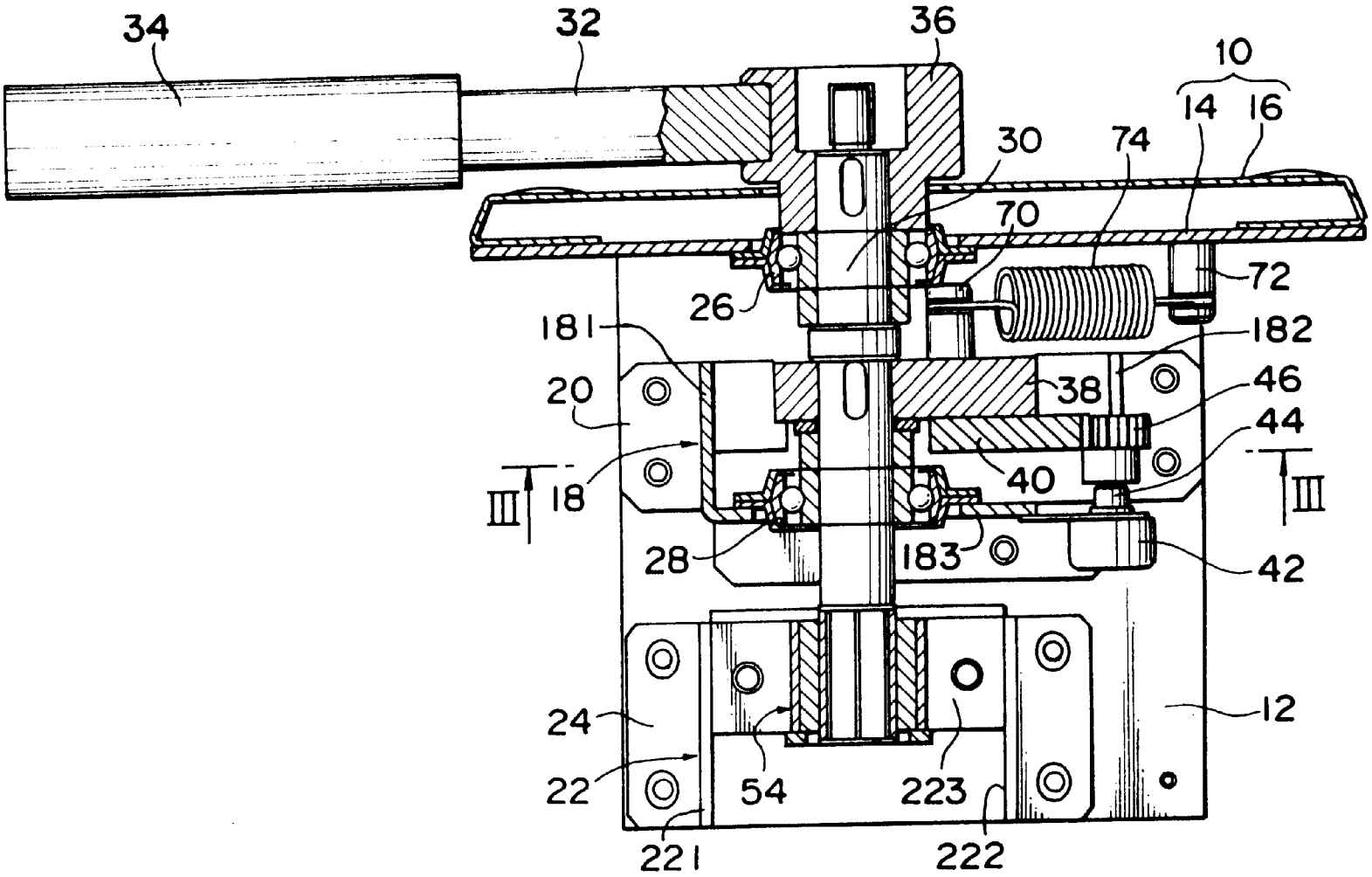
FIG. 2 is a transverse sectional view showing the principal part of the control lever device according to the present invention.
Figure 3:
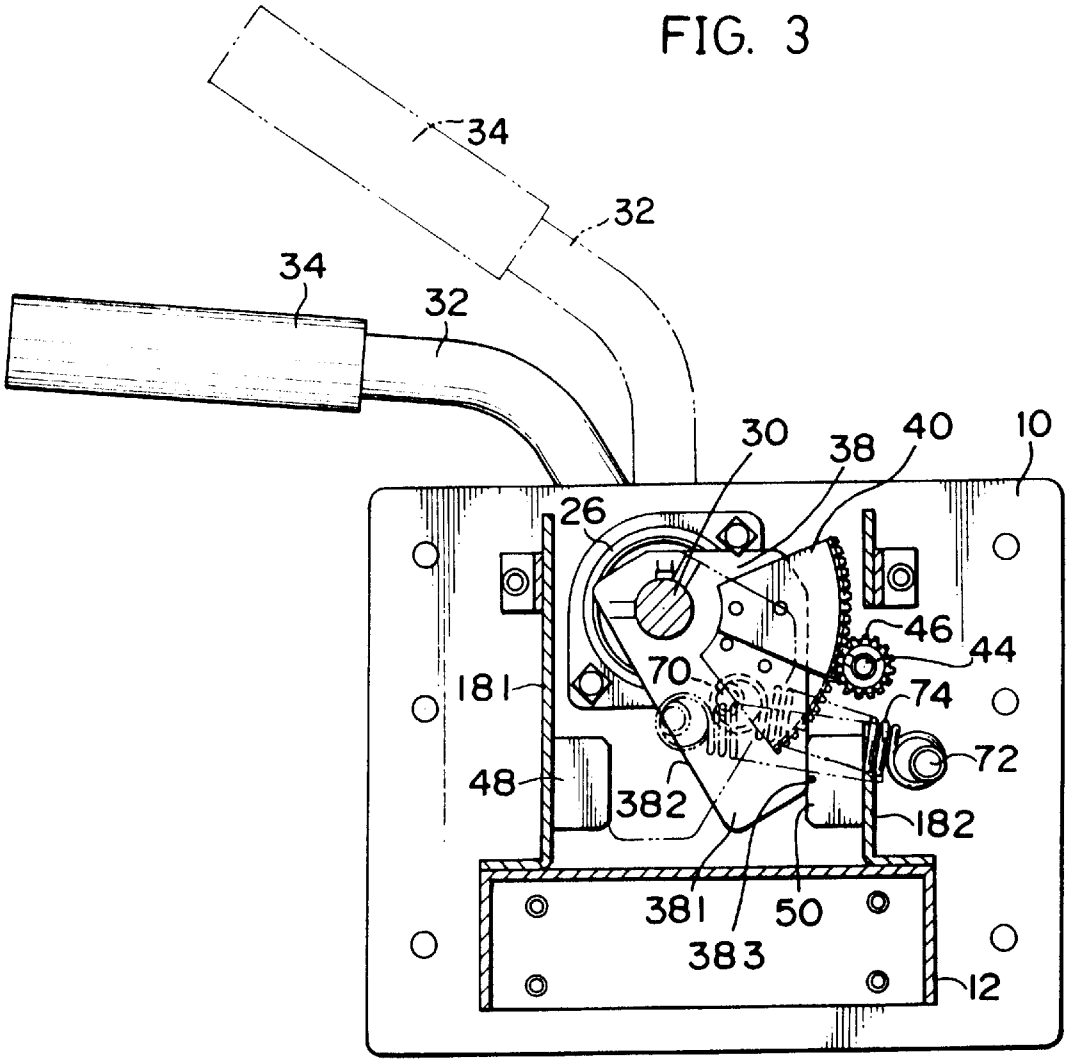
FIG. 3 is a cross-sectional view of the control lever device taken along the line A—A in FIG. 2.

FIGS. 2 and 3 are views explaining the structure of the control lever device 7 which is applied as a hand brake. FIG. 2 is a transverse sectional view showing the principal part of the control lever device 7, and FIG. 3 is a sectional view taken along the line A—A in FIG. 2. Referring to these figures, the control lever device 7 is provided with a panel 10 standing upright, and a base 12 mounted on the rear side (the lower side in FIG. 2) of the panel 10. The panel 10 is composed of a base plate 14, and a covering member 16 attached to the front side (the upper side in FIG. 2) of the base plate 14. Moreover, a front support member 20 having an upright support plate 18 is mounted in the center of the base 12, and a rear support member 24 having an upright support plate 22 is mounted at the rear end of the base 12.

The upright support plate 18 of the front support member 20 comprises a left support section 181 and a right support section 182 respectively positioned on the left and right sides facing the panel 10, and a center support section 183 for linking the left support section 181 and the right support section 182 at the rear side (the lower side in FIG. 2). The upright support plate 22 of the rear support member 24 comprises a left support section 221 and a right support section 222 respectively positioned on the left and right sides facing the panel 10, and a center support section 223 for linking the left support section 221 and the right support section 222 at the top thereof.

The base plate 14 of the panel 10 and the center support section 183 of the front support member 20 are respectively provided with bearings 26 and 28, by which a shaft 30 is rotatably supported. The shaft 30 has a length such that one end thereof projects ahead of the panel 10 and the other end is placed on the rear support member 24. These bearings 26 and 28 and the shaft 30 constitute a mechanism for turning a lever 32 which will be described later.

Mounted at one end of the shaft 30 is the lever 32 located on the front side (the upper side in FIG. 2) of and along the panel 10. The lever 32 is provided with a grip 34 at one end and a boss 36 at the other end, and is integrally attached to the shaft 30 through the fitting of the boss 36 on one end of the shaft 30. Such attachment of the lever 32 to the end of the shaft 30 facilitates mounting and replacing operations of the lever 32. A gear support plate 38 is mounted at the center of the shaft 30 so that it turns together with the shaft 30. Attached to the gear support plate 38 is a transmitting gear 40 shaped like a sector which is about one-eighth the size of a circular gear. The transmitting gear 40 is located at such a position as to be concentric with the shaft 30, that is, at a position where the axial center of the shaft 30 coincides with the turn center of the transmitting gear 40.

At the end of the center support section 183 of the front support member 20 on the side of the right support section 182, a rotary variable resistor 42 serving as a component of a detection means for detecting the amount of turn of the lever 32 from the reference position is mounted with a rotary shaft 44 facing toward the panel 10. The rotary shaft 44 of the variable resistor 42 is provided with a transmitted gear 46 which is engaged with the transmitting gear 40. Through this engagement, the turning motion of the lever 32 is transmitted to the rotary shaft 44 of the variable resistor 42 through the shaft 30, and the rotary shaft 44 of the variable resistor 42 is turned through an angle corresponding to the amount of turn of the lever 32, whereby a resistance present at the output end of the variable resistor 42 is changed. In the above-mentioned driving game machine, the resistance of the variable resistor 42 is converted into a voltage at a level corresponding thereto by an unillustrated voltage converter, and a required game operation is performed according to the voltage.

The gear support plate 38 includes an extended section 381 extending from the shaft 30, which supports the gear support plate 38, toward the base 12. A stopper 48 made of an elastic material such as rubber is mounted on the left support section 181 of the front support member 20 at a position corresponding to a left side surface 382 located on the left side of the extended section 381 facing the panel 10, and a stopper 50 made of an elastic material such as rubber is mounted on the right support section 182 of the front support member 20 at a position corresponding to a right side surface 383 located on the right side of the extended section 381 facing the panel 10. The reference position of the lever 32 (a position shown by the solid line in FIG. 2) where no turning force is applied thereto is defined by the contact of the gear support plate 38 with the stopper 50, and the terminal position where the lever 32 is turned through a required angle by the applied turning force (a position shown by a chained line in FIG. 2) is defined by the contact of the gear support plate 38 with the stopper 48. In other words, the stoppers 48 and 50 each made of an elastic material allow the lever 32 to be turned through a required angle (i.e., about 30°) between the reference position and the terminal position, and furthermore, even if the gear support plate 38 makes contact with the stopper 48 or 50 during operation of the lever 32, the impact of contact is lessened and not a great amount of impact is transmitted to the hand of the player, which prevents the player from discomfort.

Figure 4A:
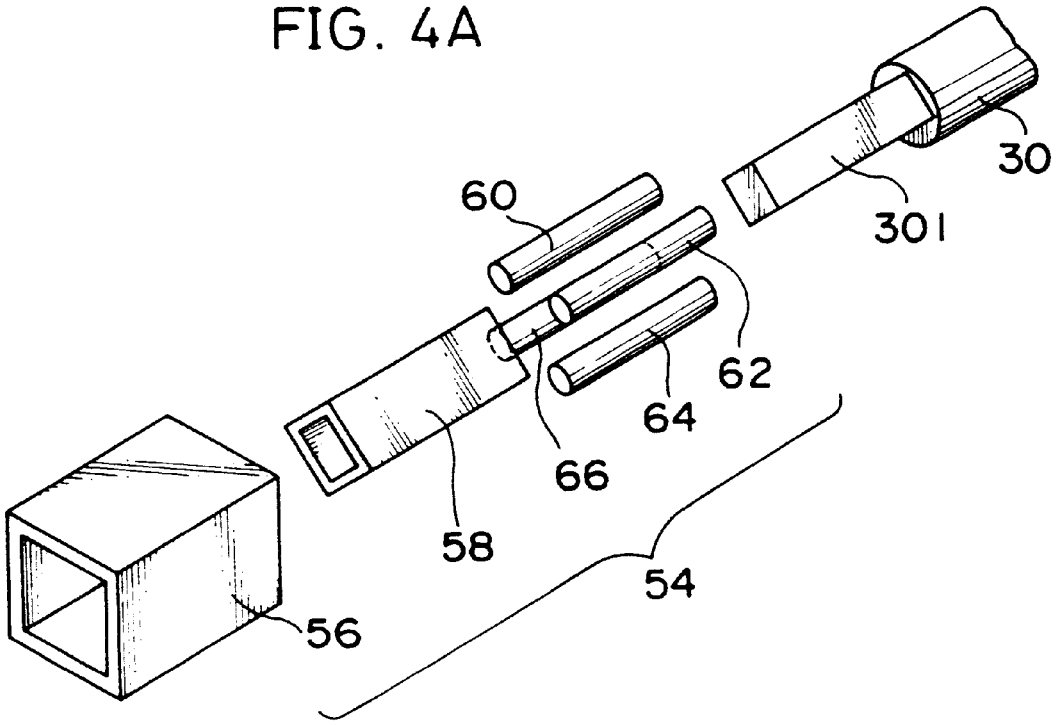
FIG. 4A is an exploded perspective view showing the structure of an urging force applying member in the control lever device shown in FIG. 2.
Figure 4B:
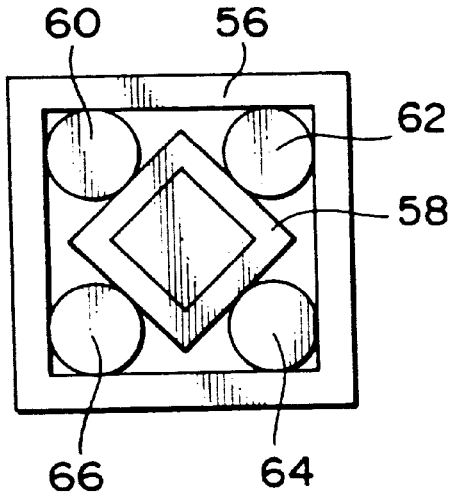
FIG. 4B is a front view of the urging force applying member.

An urging force applying member 54 is attached at the other end of the shaft 30 which is located on the rear support member 24. FIGS. 4A and 4B are respectively exploded perspective and front views showing the structure of the urging force applying member 54. Specifically, the urging force applying member 54 comprises an outer prismatic member 56 having a square cross-section and made of metal or the like, an inner prismatic member 58 having a square cross-section and made of metal or the like, and four circular cylindrical elastic members 60, 62, 64, and 66 made of urethane synthetic resin, rubber, or the like. The inner prismatic member 58 is placed in the outer prismatic member 56 while being shifted by about 45° in the circumferential direction so that the corners thereof are respectively positioned at the centers of the sides of the outer prismatic member 56. The elastic members 60, 62, 64, and 66 are press-fitted into the spaces defined by the corners of the outer prismatic member 56 and the inner prismatic member 58.

Figure 5:
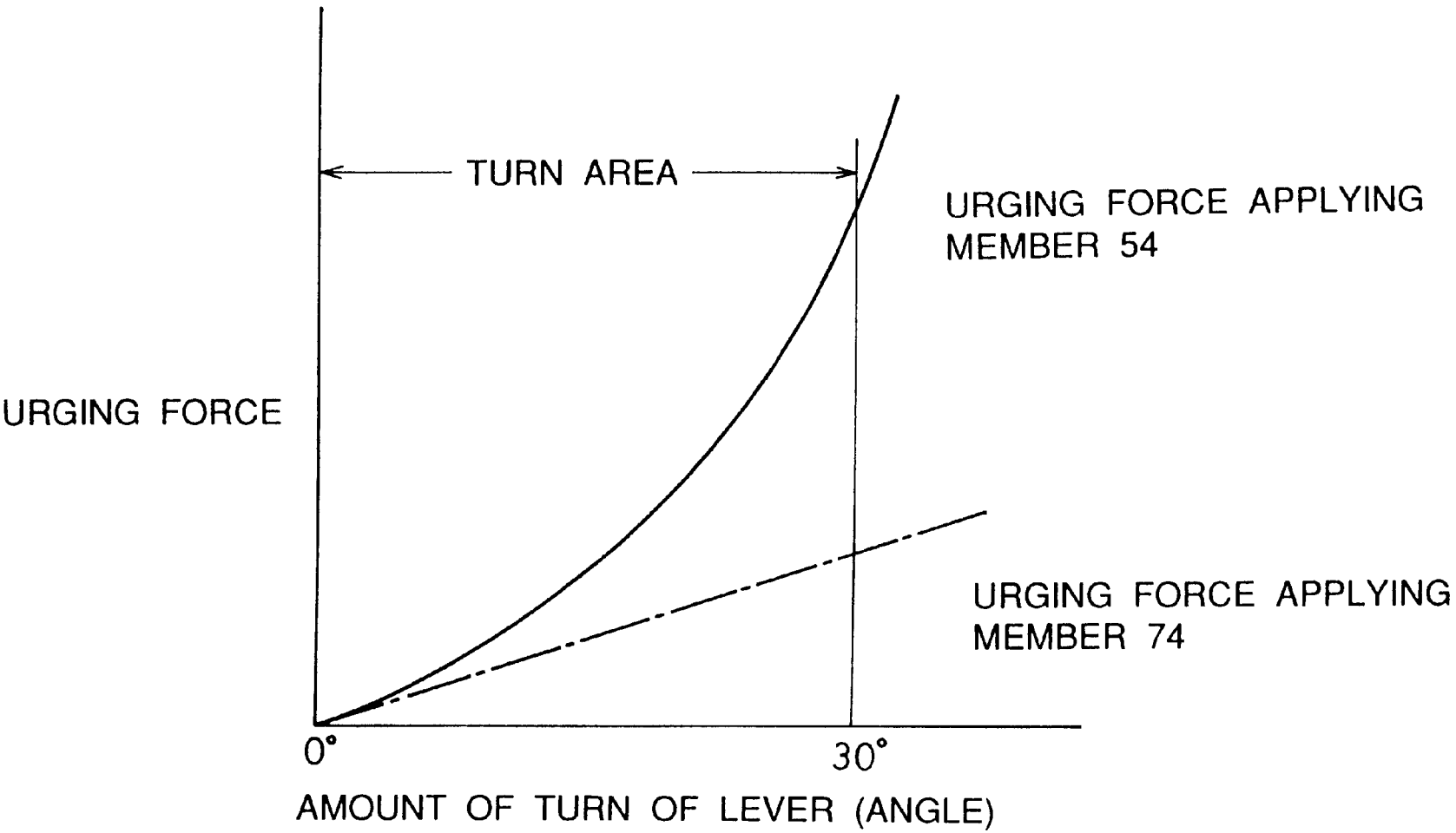
FIG. 5 is a graph showing the relationship between the amount of turn of the control lever device shown in FIG. 2 and the urging force to be applied by the urging force applying member.

On the other hand, the other end 301 of the shaft 30 is, as shown in FIG. 4A, shaped like a prism with square cross-section, and fitted in the inner prismatic member 58 of the urging force applying member 54. Through this fitting, when the lever 32 turns and the shaft 30 thereby turns, the inner prismatic member 58 turns simultaneously, and the elastic members 60, 62, 64 and 66 are compressed and deformed while rolling in the turning direction of the inner prismatic member 58, whereby the lever 32 is given an urging force in a direction which returns the lever 32 to the reference position. The urging force applying member 54 thus constructed has a non-linear urging force generating characteristic (spring characteristic) in which the generation rate of the urging force relative to the amount of turn (turn angle) of the lever 32 increases as the amount of turn of the lever 32 increases, at least within the turn angle (i.e., about 30°) of the lever 32, as shown in FIG. 5. This urging force generating characteristic can be adjusted by changing the diameter, length, material and the like of the elastic members 60, 62, 64, and 66.

While a first retaining projection 70 is formed on the surface of the gear support plate 38 facing the panel 10, a second retaining projection 72 is formed on the surface of the base 14, which is a component of the panel 10, facing the gear support plate 38. Another urging force applying member 74 formed of a tension coil spring is retained by the first and second retaining projections 70 and 72 at both ends thereof. When the lever 32 turns and the shaft 30 also turns, the urging force applying member 74 is stretched, and an urging force is thereby applied to the lever 32 in a direction which returns the lever 32 to the reference position. The urging force applying member 74 has a linear urging force generating characteristic (spring characteristic) in which the generation rate of the urging force relative to the amount of turn of the lever 32 is almost constant at least within the turn angle of the lever 32, as shown in FIG. 5. In this embodiment, the strength of the tension coil spring is set smaller than the urging force of the urging force applying member 54.

In the control lever device having such urging force applying members 54 and 74, when the turning force is applied to the lever 32 by pulling the lever 32 upward from the reference position, the urging force is given to the lever 32 by means of both the urging force applying members 54 and 74. This urging force increases exponentially as the amount of turn of the lever 32 increases, and increases, for example, to a value which is several tens to several hundreds of times as great as the initial value at the beginning of the turn when the lever 32 comes close to the terminal position. As a result, it is possible to obtain a feeling of operation that is similar to that of the hand brake of an actual car. Furthermore, since the lever 32 is being applied with a great urging force by both the urging force applying members 54 and 74, it is swiftly returned to the reference position by the urging force when the turning operation thereof is released, and immediately made ready for the next lever operation. Consequently, the control lever device is suitable for use in a game machine which is frequently and repeatedly used.

The control lever device of the present invention is constructed as mentioned above and turned between the reference position and the terminal position under the control of the player, and various modifications below are possible. Specifically, although the transmitting gear 40 is attached to the gear support plate 38 in the aforesaid embodiment, it may be directly mounted onto the shaft 30. In this case, the same function as the gear support plate 38 in the above embodiment can be obtained by providing a contact plate for the stoppers 48 and 50 to a part of the transmitting gear 40. Moreover, the transmitting gear 40 may be mounted onto a gear support section which is integrally formed near the turn center of the lever 32.

Furthermore, although the turn of the lever 32 is transmitted to the rotary shaft 44 of the variable resistor 42 through the transmitting gear 40 and the transmitted gear 46 in the above embodiment, for example, the shaft 30 and the rotary shaft 44 may be respectively provided with pulleys so that the rotation of the pulley on the side of the shaft 30 is transmitted to the pulley on the rotary shaft 44 through a timing belt.

Although the resistance of the variable resistor 42 is changed in accordance with the amount of turn of the lever 32 and converted into a voltage at a corresponding level in the above embodiment, other electrical characteristics, such as an inductance or an electrostatic capacity, may be changed instead of the resistance, and converted into a voltage at a corresponding level. Moreover, the amount of turn of the lever 32 may be detected by using a rotary encoder. In this case, the rotation of the shaft 30 may be directly detected without using a rotary transmitting member such as a gear.

Furthermore, although the urging force applying member 54 is composed of the outer prismatic member 56 with a square cross-section, the inner prismatic member 58 with a square cross-section, and the circular cylindrical elastic members 60 to 66 in the above embodiment, the outer prismatic member 56 and the inner prismatic member 58 each may have a polygonal cross-section other than a square cross-section as long as they have a similar shape, and the inner prismatic member 58 does not need to be always provided with a hole into which the shaft 30 is inserted. In that case, the shaft 30 may be fixed by screwing or the like. Moreover, the elastic members 60 to 66 may be each shaped like a prism. In other words, the urging force applying member 54 may be composed of a many-sided cylindrical member, a prismatic member to be loosely fitted in the many-sided cylindrical member and having a similar shape thereto (with or without a hole for inserting the shaft therein), and pillar-shaped elastic members to be press-fitted between the corners of the many-sided cylindrical member and the prismatic member, in which the corners of the prismatic member are respectively located at the centers of the sides of the many-sided cylindrical member, that is, each located inside the many-sided cylindrical member so as to provide a phase difference of half a pitch in the circumferential direction. Moreover, the urging force may be applied to the lever 32 only by the urging force applying member 54.

Though the control lever device of the present invention is applied to a hand brake of a driving game machine in the above embodiment, it is applicable to other uses, such as a control stick of an airplane as a game machine.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A control lever device comprising:

a lever;

a turning mechanism for allowing said lever to turn between a reference position and a terminal position;

detecting means for detecting the amount of turn of said lever from the reference position; and urging force applying means for applying, in turning said lever, an urging force to said lever in a direction which returns said lever to the reference position, and having an urging force generating characteristic which is non-linear in that the ratio of the urging force relative to the amount of turn of said lever increases as the amount of turn of said lever increases.

2. A control lever device comprising:

a lever having a turn center;

a turning mechanism for allowing said lever to turn between a reference position and a terminal position, said turning mechanism having a shaft mounted at the turn center of said lever;

detecting means for detecting the amount of turn of said lever from the reference position;

urging force applying means for applying, in turning said lever, an urging force to said lever in a direction which returns said lever to the reference position, and having an urging force generating characteristic wherein the generation rate of the urging force relative to the amount of turn of said lever increases as the amount of turn of said lever increases;

said urging force applying means comprising a many-sided cylindrical member, a prismatic member having a similar shape to said many-sided cylindrical member and loosely fitted in said many-sided cylindrical member with a phase difference of half a pitch in the circumferential direction, and pillar-shaped elastic members to be press-fitted between the corners of said many-sided cylindrical member and said prismatic member.

3. A control lever device according to claim 2, wherein said shaft has a turn transmitting member to be turned together therewith, said detecting means has a rotary shaft with a turn transmitted member and gains an electrical characteristic corresponding to the amount of turn of said rotary shaft, and said turn transmitted member is turned by said turn transmitting member.

4. A control lever device according to claim 3, wherein said turn transmitting member comprises a gear support plate integrally mounted on said shaft and a transmitting gear mounted on said gear support plate concentrically with said shaft, and said turn transmitted member is composed of a transmitted gear meshed with said transmitting gear.

5. A control lever device according to claim 4, further comprising:

stoppers for regulating the reference position and the terminal position of said lever by the contact of said gear support plate therewith.

6. A control lever device according to either of claims 1 to 5, further comprising:

another urging force applying means for applying, in turning said lever, an urging force to said lever in a direction which returns said lever to the reference position, in cooperation with said urging force applying means.

7. A control lever device according to claim 6, wherein said another urging force applying means is formed of a tension coil spring.

8. A control device comprising:

a lever;

a turning mechanism for allowing said lever to turn between a reference position and a terminal position;

detecting means for detecting the amount of turn of said lever from the reference position; and urging force applying means for applying, in turning said lever, an urging force to said lever in a direction which returns said lever to the reference position, and having an urging force generating characteristic which is non-linear in that the ratio of the urging force relative to the amount of turn of said lever continuously increases as the amount of turn of said lever increases from the reference position to said terminal position.

9. A control lever apparatus comprising:

a lever;

a turning device allowing said lever to turn;

an urging mechanism for applying an urging force to said lever urging said lever to turn in a return direction upon application of an applied force to said lever tending to force said lever to turn in an applied direction opposite to said return direction;

said urging force continuously increasing at a rate greater than the rate of increase of turn of said lever in said applied direction increases such that the ratio of said urging force relative to the amount of turn of said lever in said applied direction increases non-linearly.

10. A control lever according to claim 9 wherein said urging mechanism includes at least one elastic member which is compressed and temporarily deformed as said lever turns in said applied direction.

11. A control lever according to claim 10 wherein said elastic member is selected from the group consisting of urethane synthetic resin and rubber.

12. A control lever apparatus comprising:

a lever;

a turning device allowing said lever to turn;

an urging mechanism for applying an urging force to said lever urging said lever to turn in a return direction upon application of an applied force to said lever tending to force said lever to turn in an applied direction opposite to said return direction, said urging mechanism including a first member having an internal non-circular surface, a second member having an external non-circular surface, said second member being disposed within said first member, and an elastic member disposed within said first member between said internal and external non-circular surfaces;

said urging force continuously increasing as the amount of turn of said lever in said applied direction increases;

the rate of increase of said urging force increasing continuously as the amount of turn of said lever in said applied direction increases.

13. A control lever according to claim 12 wherein said internal non-circular surface on said first member is a polygonal surface and said external non-circular surface on said second member is a polygonal surface.

14. A control lever according to claim 13 wherein the polygonal surface of said first member has a center and a plurality of corners, the polygonal surface of said second member having a center and a plurality of corners, the center of said polygonal surface of said first member coinciding with the center of said polygonal surface of said second member, the corners of said polygonal surface of said first member being displaced from radial alignment with the corners of said polygonal surface of said second member.

15. A control lever according to claim 13 wherein the polygonal surface of said first and second members have a plurality of flat sides joined to one another at corners, said elastic member being disposed at the corner of the polygonal surface of one of said first and second members, said elastic member engaging a flat side of the polygonal surface of the other of said first and second members.

16. A control lever according to claim 13 wherein the polygonal surface on said first member has the same number of sides as the polygonal surface on said second member.

17. A control lever apparatus comprising:

a lever;

a turning device allowing said lever to turn; and an urging mechanism for applying an urging force to said lever urging said lever to turn in a return direction upon application of an applied force to said lever tending to force said lever to turn in an applied direction opposite to said return direction, said urging force increasing exponentially as the amount of turn of said lever in said applied direction increases.

18. A control lever device comprising:

a lever having a turn center;

a turning mechanism allowing said lever to turn between a reference position and a terminal position, said turning mechanism having a shaft mounted at the turn center of said lever;

urging force applying means for applying an urging force to said lever in a direction tending to turn said lever toward the reference position, and having an urging force generating characteristic wherein the generation rate of the urging force increases in a direction toward said terminal position;

said urging force applying means comprising a plural-sided hollow member, a prismatic member with plural sides and having a similar shape to said plural-sided hollow member and loosely fitted in said plural-sided hollow member with a phase difference of half a pitch between the sides of said plural-sided hollow member and the sides of said prismatic member, and pillar-shaped elastic members between the corners of said plural-sided hollow member and said prismatic member.

* * * * *